US011383885B2

(12) United States Patent
Yosufy

(10) Patent No.: US 11,383,885 B2
(45) Date of Patent: Jul. 12, 2022

(54) COLLAPSIBLE BEVERAGE CONTAINER

(71) Applicant: Sal Yosufy, Elk Grove, CA (US)

(72) Inventor: Sal Yosufy, Elk Grove, CA (US)

( * ) Notice: Subject to any disclaimer, the term of this patent is extended or adjusted under 35 U.S.C. 154(b) by 0 days.

(21) Appl. No.: 17/032,941

(22) Filed: Sep. 25, 2020

(65) Prior Publication Data

US 2021/0086945 A1 Mar. 25, 2021

Related U.S. Application Data

(60) Provisional application No. 62/879,060, filed on Jul. 26, 2019.

(51) Int. Cl.

| | |
|---|---|
| ***B65D 21/08*** | (2006.01) |
| ***B65D 51/18*** | (2006.01) |
| ***B65D 25/36*** | (2006.01) |
| ***B65D 43/02*** | (2006.01) |
| ***B65D 25/56*** | (2006.01) |

(52) U.S. Cl.

CPC ..... *B65D 21/086* (2013.01); *B65D 25/36* (2013.01); *B65D 25/56* (2013.01); *B65D 43/0208* (2013.01); *B65D 51/18* (2013.01); *B65D 2543/00231* (2013.01); *B65D 2543/00555* (2013.01); *B65D 2543/00842* (2013.01)

(58) Field of Classification Search

CPC .. B65D 21/086; B65D 25/56; B65D 43/0208; B65D 1/0292; B65D 21/068

See application file for complete search history.

(56) References Cited

U.S. PATENT DOCUMENTS

| | | | | |
|---|---|---|---|---|
| 8,833,587 | B2 * | 9/2014 | Forsyth | A47G 19/2272 220/254.4 |
| 11,026,527 | B2 * | 6/2021 | Tsui | A45F 3/20 |
| 2006/0091142 | A1 * | 5/2006 | Topalian | B65D 1/265 220/675 |
| 2012/0217238 | A1 * | 8/2012 | Chang | B65D 21/08 220/8 |

* cited by examiner

*Primary Examiner* — Jeffrey R Allen
(74) *Attorney, Agent, or Firm* — Sandy Lipkin

(57) ABSTRACT

The present invention provides a beverage container that is user friendly and ecofriendly. The present invention has three components which can be used irrespective of each other. According to a preferred embodiment, the present invention is spill proof and leak proof making it perfect for users to carry around. Further, the present invention is collapsible, which allows for compact storage. Furthermore, the present invention comprises braille impression outside the container and indicia inside the container for effectively indicating the volume of the container. Additionally, the lid of the present invention comprises multiple drinking ports, and a lid closure for making the container spill proof, irrespective of the drinking mode chosen by the user. Thus, the present invention allows the user to have a travel friendly, compact, ecofriendly, and reusable beverage holder with a detachable lid and lid closure.

2 Claims, 10 Drawing Sheets

COLLAPSIBLE BEVERAGE CONTAINER

The current application claims a priority to the U.S. Provisional Patent application Ser. No. 62/879,060 filed on Jul. 26, 2019.

FIELD OF THE INVENTION

The present invention relates generally to a storage apparatus for any hot or cold beverages. More specifically, the present invention is a reusable, economic, ecofriendly, and travel friendly beverage container, that is collapsible.

BACKGROUND OF THE INVENTION

Most of us are always on the hunt to find the perfect reusable travel cup. Users worldwide look for an option to carry hot or cold beverages conveniently and safely. However, most of the reusable travel cups are made of hard materials which makes them heavy to carry around whereas, some of the lighter ones are not ecofriendly to the nature. A reusable travel cup with an ergonomic design that allows the beverage container to be placed in a beverage cup holder and/or in the user's hand, (like a disposable cup) is always a preferred cup design. Further, a beverage cup with an easily detachable, yet secure and spill proof lid is another feature, users wish for. Furthermore, the way people drink from a cup also varies from person to person. However, a travel cup that has all the above-mentioned features is a rare find in the current market.

It is an objective of the present invention to provide a beverage container that is user friendly, ecofriendly, and has an ergonomic design. The present invention has three components made from a single material, and which may be used irrespective of each other. According to a preferred embodiment, the present invention is spill proof and leak proof, making it an ideal choice for users to carry around. Further, the present invention is collapsible, which allows for compact storage. Furthermore, the present invention comprises braille impression outside the container and indicia inside the container for effectively indicating the volume of the container. Additionally, the lid of the present invention comprises multiple drinking ports, and a lid closure for making the container spill proof, irrespective of the drinking mode chosen by the user. Thus, the present invention allows the user to have a travel friendly, compact, ecofriendly, and reusable beverage holder with a detachable lid and lid closure.

DETAIL DESCRIPTIONS OF THE INVENTION

Figure 1:
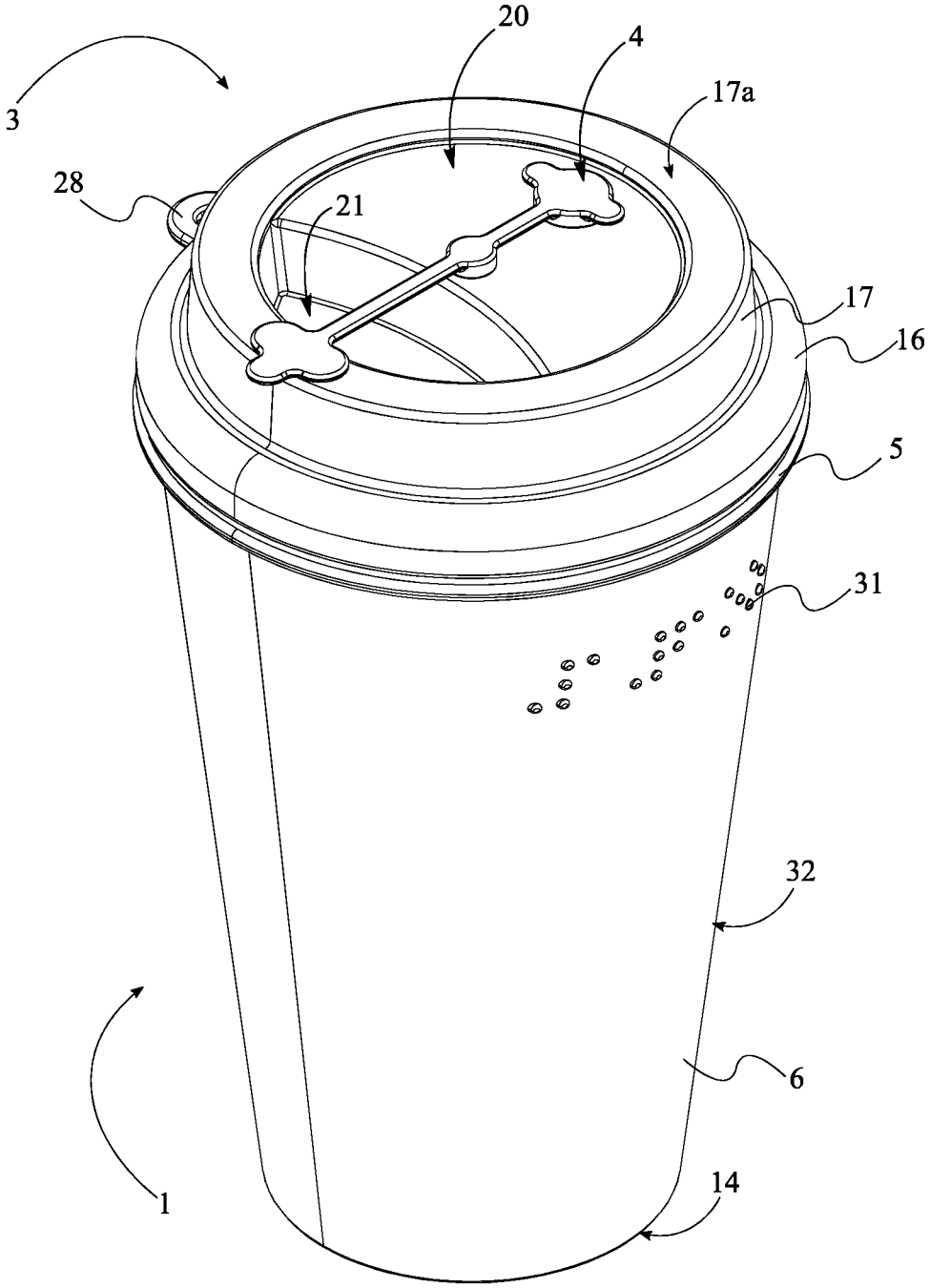
FIG. 1 is a top-front left perspective view of the present invention.

All illustrations of the drawings are for the purpose of describing selected versions of the present invention and are not intended to limit the scope of the present invention.

In reference to FIG. 1 through FIG. 10, the present invention is a collapsible beverage container. It is an objective of the present invention to provide a beverage container that is user friendly, ecofriendly, and has an ergonomic design. The present invention has three components made from a flexible and ecofriendly material, which may be used irrespective of each other. According to a preferred embodiment, the present invention is spill proof and leak proof making it perfect for users to carry around. Further, the present invention is collapsible, which allows for compact storage. Furthermore, the present invention comprises braille impression outside the container and indicia inside the container for effectively indicating the volume of the container. Additionally, the lid of the present invention comprises multiple drinking ports, and a lid closure for making the container spill proof, irrespective of the drinking mode chosen by the user. Thus, the present invention allows the user to have a travel friendly, compact, ecofriendly, and reusable beverage holder with a detachable lid and lid closure.

The following description is in reference to FIG. 1 through FIG. 10. According to a preferred embodiment, the present invention comprises a receptacle 1, an inner compartment 2, a lid 3, and a lid closure 4. As seen in FIG. 1 through FIG. 10, the receptacle 1 comprises a rim 5, at least one lateral sidewall 6, and a base 7. It is an aim of the present invention to provide a collapsible beverage container. In order to accomplish that, the at least one lateral sidewall 6 comprises a first section 8, a collapsible section 9, a second section 10, a first indentation 11, and a second indentation 12. Preferably, a first end 13 of the receptacle 1 is positioned opposite to a second end 14 of the receptacle 1 across the lateral sidewall 6, and the inner compartment 2 traverses into the receptacle 1 from the first end 13 to the second end 14. The inner compartment 2 is a storage area for liquid food items, and which may contain the user's beverage of preference. Preferably, the receptacle 1 comprises a truncated conical shape and is made of a flexible yet sturdy and temperature resistant material such as platinum-cured silicone. However, the receptacle 1 may comprise any other shape, material, size, color, components or arrangement of components that are known to one of ordinary skill in the art, as long as the objectives of the present invention are not altered.

Figure 2:
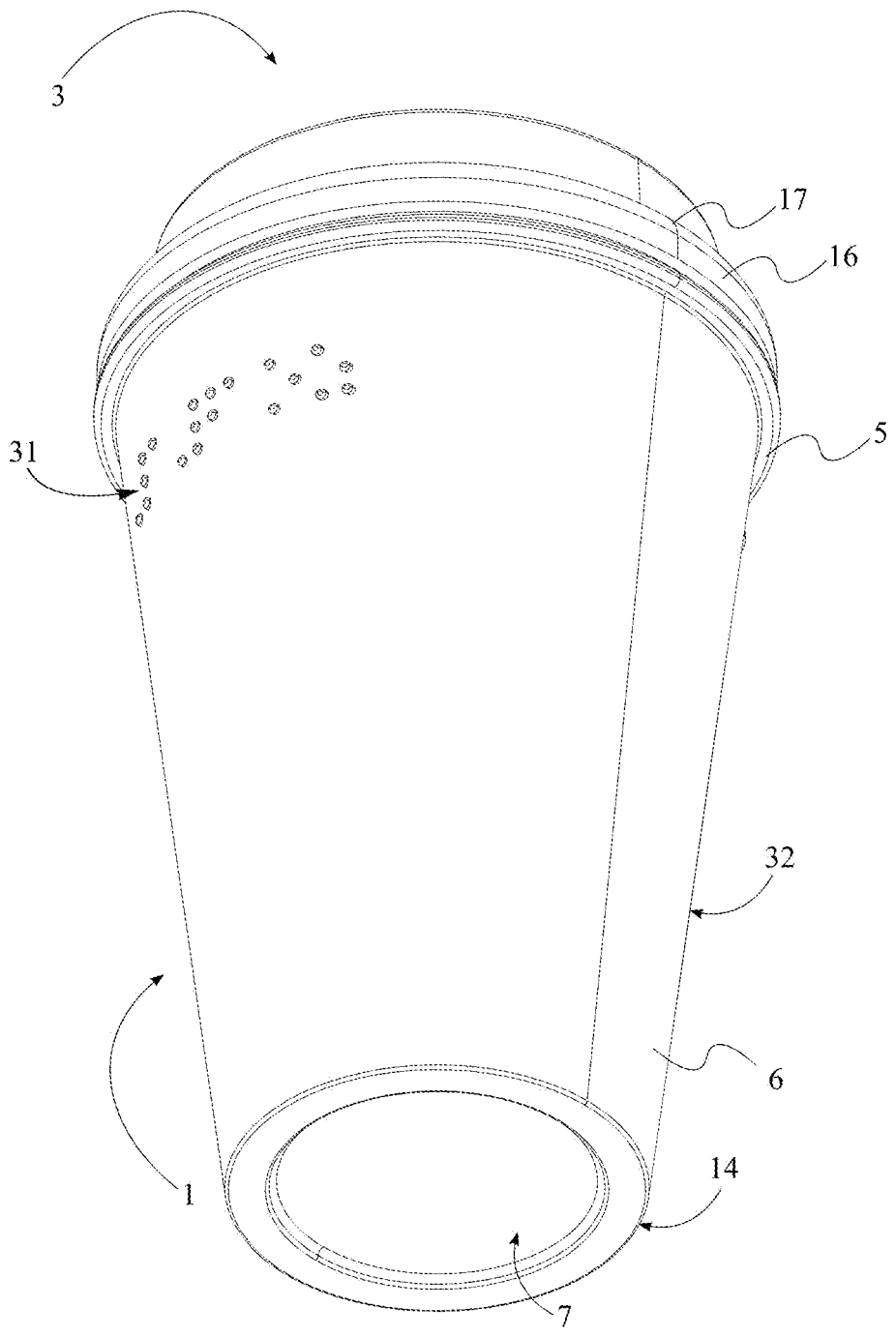
FIG. 2 is a bottom-front-right perspective view of the present invention.
Figure 3:
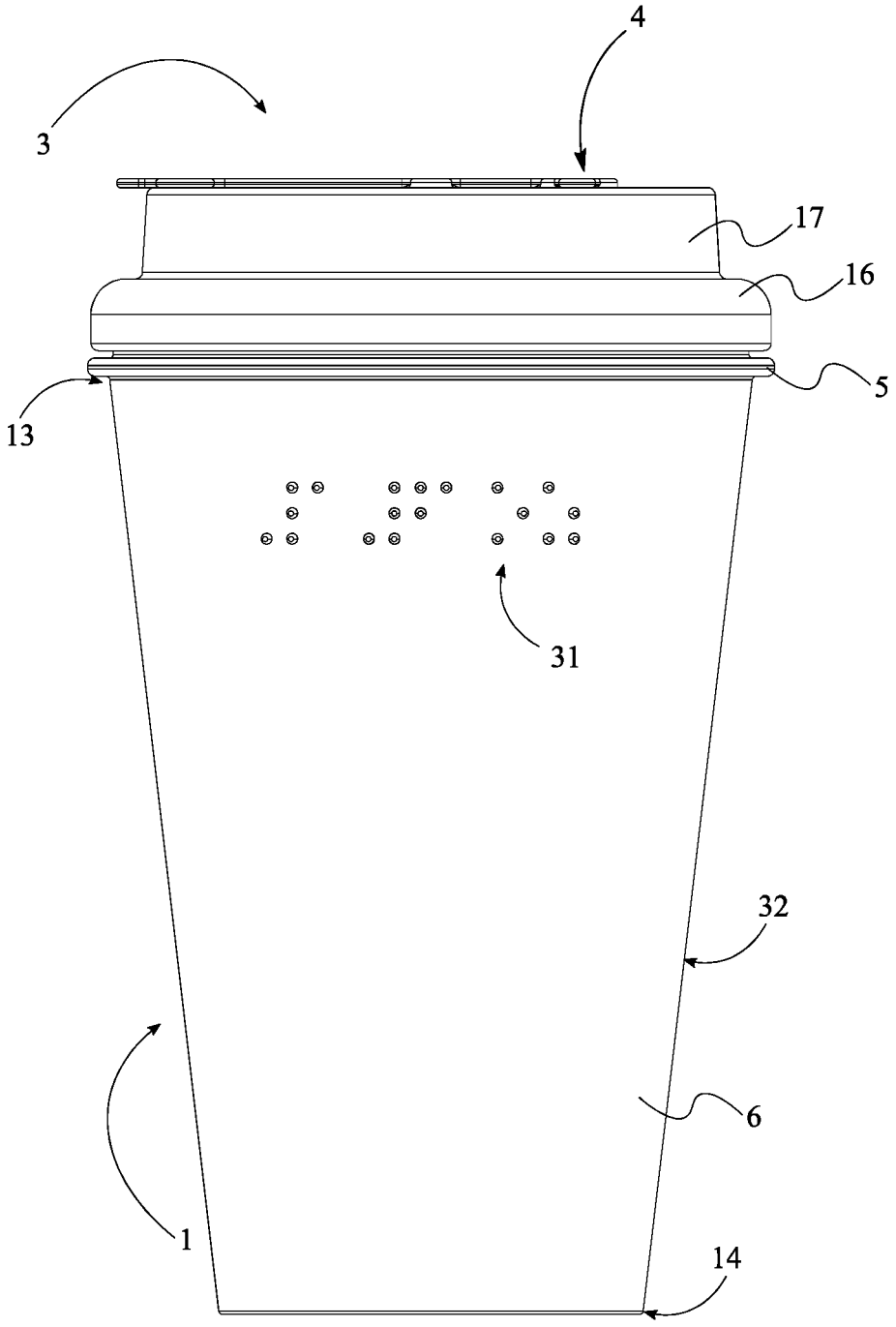
FIG. 3 is a front elevational view of the present invention.
Figure 4:
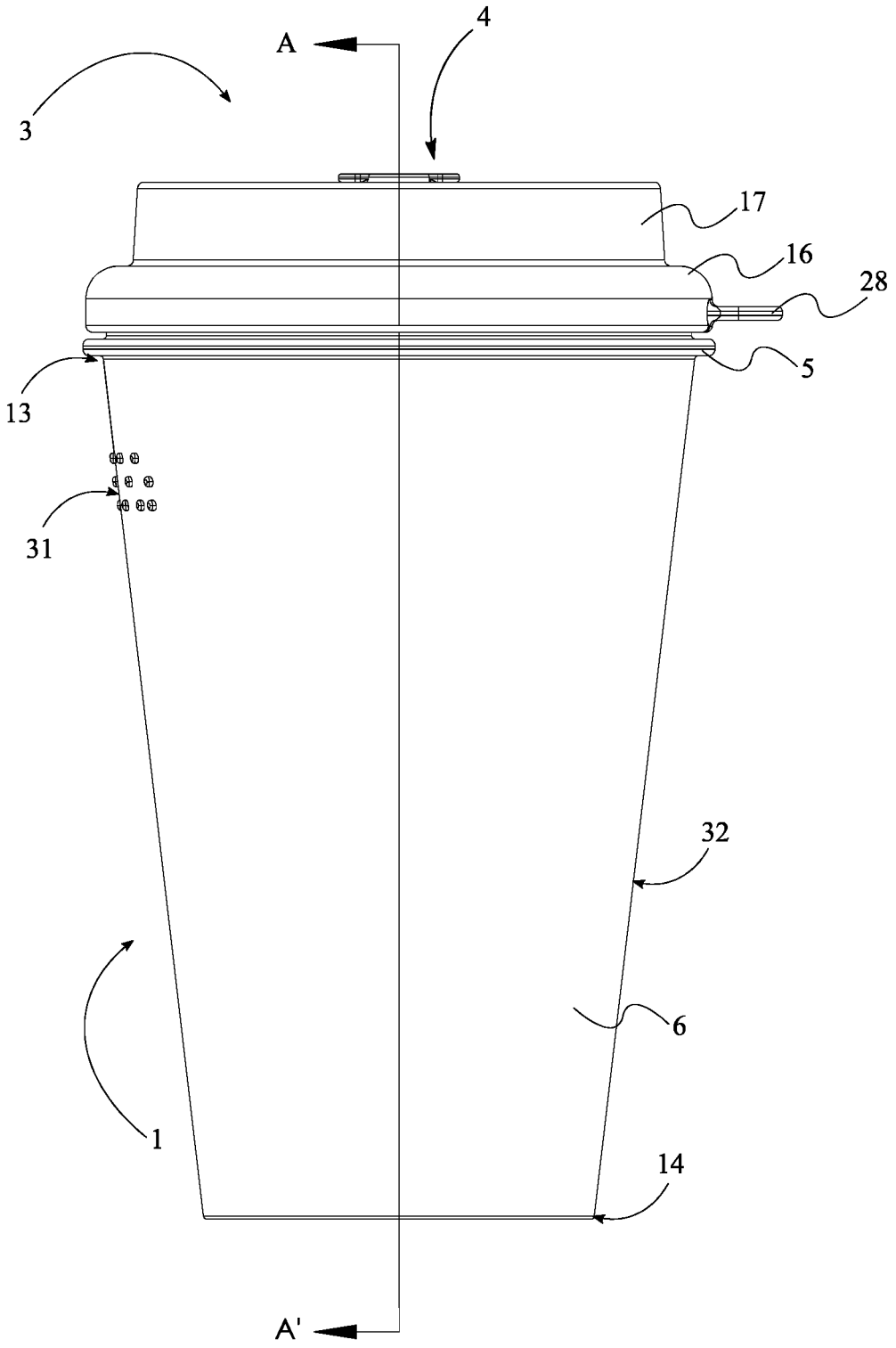
FIG. 4 is a right-side elevational view of the present invention.
Figure 6:
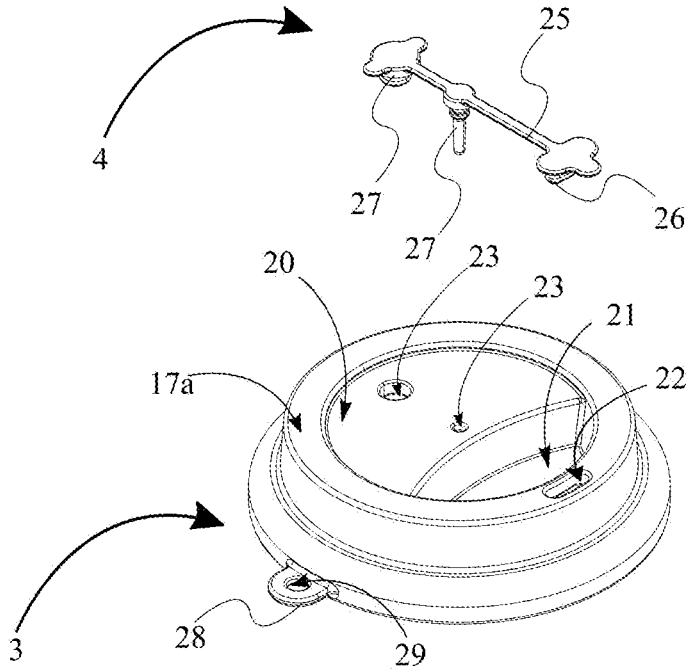
FIG. 6 is an exploded, top-rear-right perspective view of the present invention.
Figure 6:
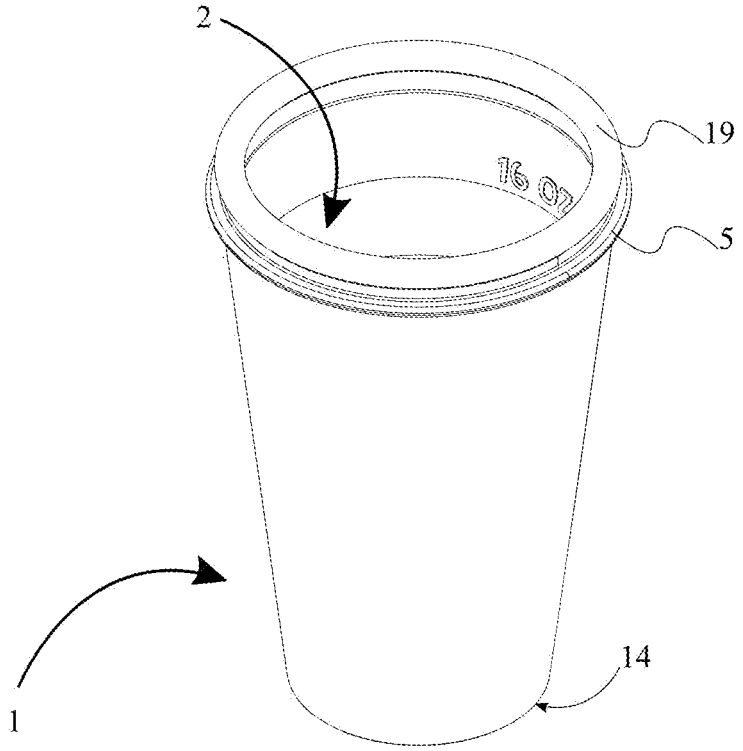
Figure 7:
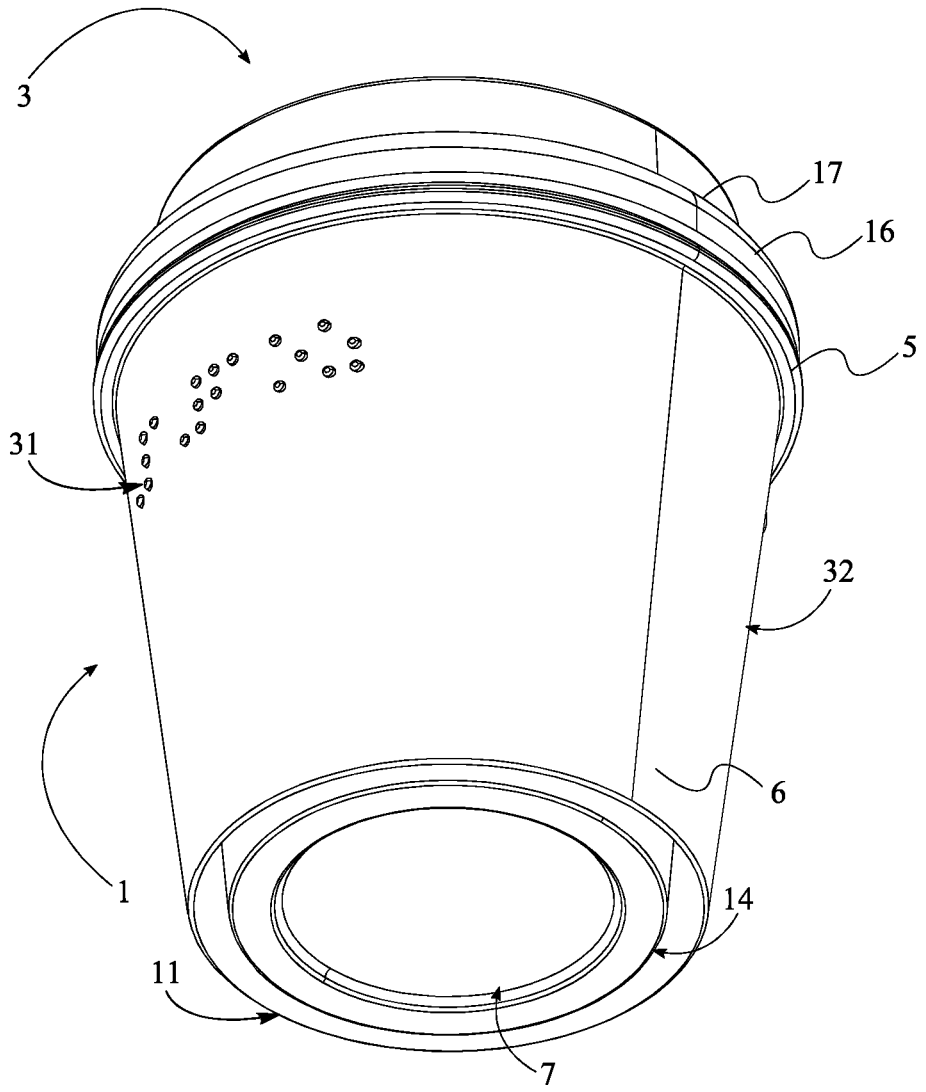
FIG. 7 is a bottom-front-right perspective view of the present invention in a collapsed configuration.

As seen in FIG. 3, FIG. 4, and FIG. 6, the rim 5 is mounted adjacent the first end 13, and as seen in FIG. 2 and FIG. 7, the base 7 is mounted adjacent the second end 14. In other words, the rim 5 and the base 7 constitute the two opposing ends of the receptacle 1. According to the preferred embodiment, the first section 8 is positioned adjacent to the first end 13, the second section 10 is positioned adjacent to the second end 14, and the collapsible section 9 is connected in between the first section 8 and the second section 10, in such a way that the lateral sidewall 6 tapers from the first end 13 to the second end 14. In other words, as the lateral sidewall 6 traverses from the second end 14 towards the first end 13, the diameter of the receptacle 1 increases gradually.

In order to accomplish the collapsibility of the beverage container, the lateral sidewall 6 folds within itself along specific lateral sections. To that end, the first indentation 11 and the second indentation 12 laterally traverse into and around an inner surface 15 of the lateral sidewall 6. Preferably, the first indentation 11 is positioned in between the first section 8 and the collapsible section 9, and the second indentation 12 is positioned in between the second section 10 and the collapsible section 9. Continuing with the preferred embodiment, when the receptacle 1 is in an extended configuration, the collapsible section 9 extends away from the first section 8. In other words, the collapsible section 9 is stretched out and does not intersect any regions of the first section 8 or the second section 10. Further, when observed from outside, the first section 8, the collapsible section 9, and the second section 10 forms a frustum-shaped body with seamless sidewalls.

Figure 8:
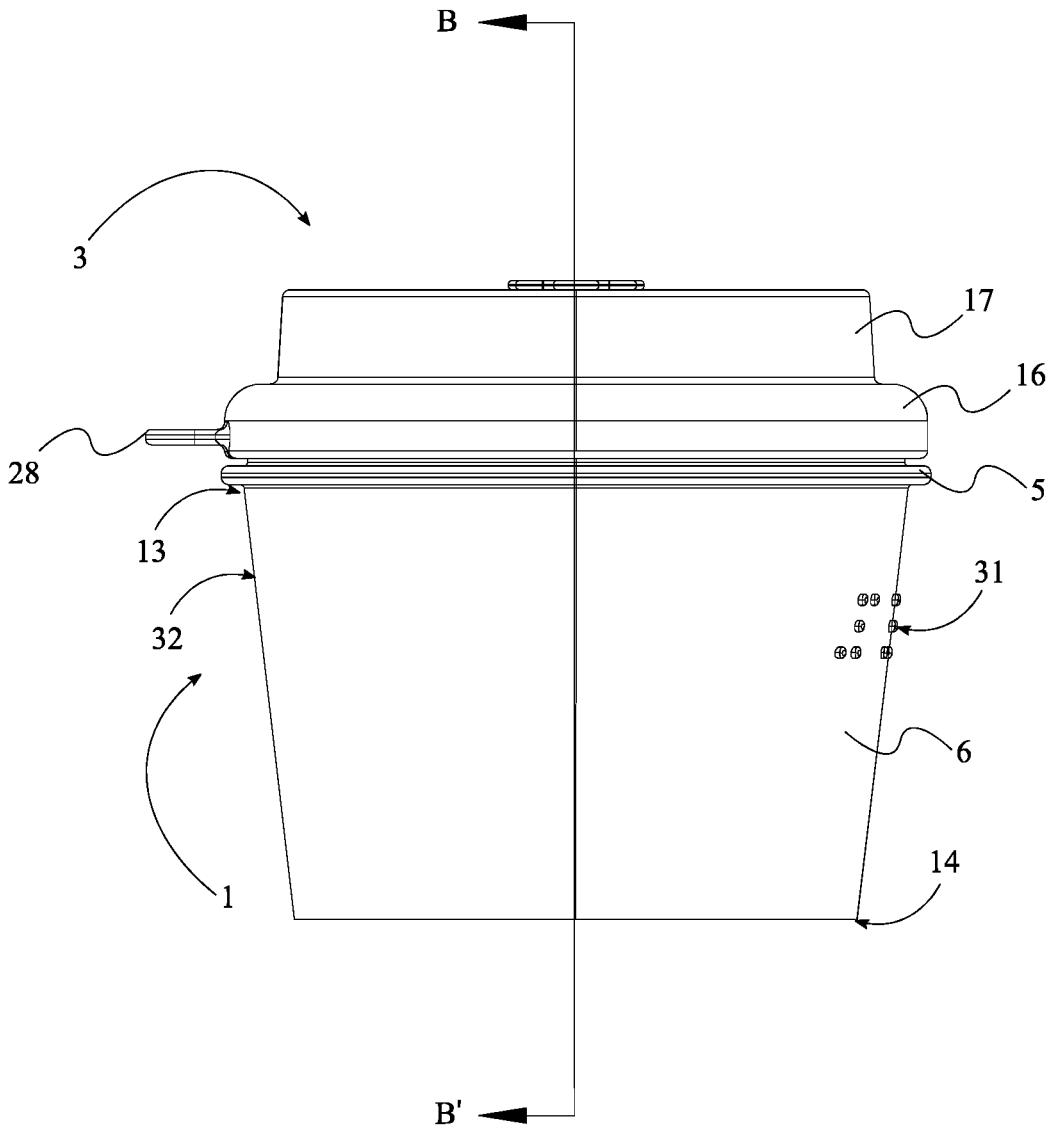
FIG. 8 is a left-side elevational view of the present invention in the collapsed configuration.
Figure 9:
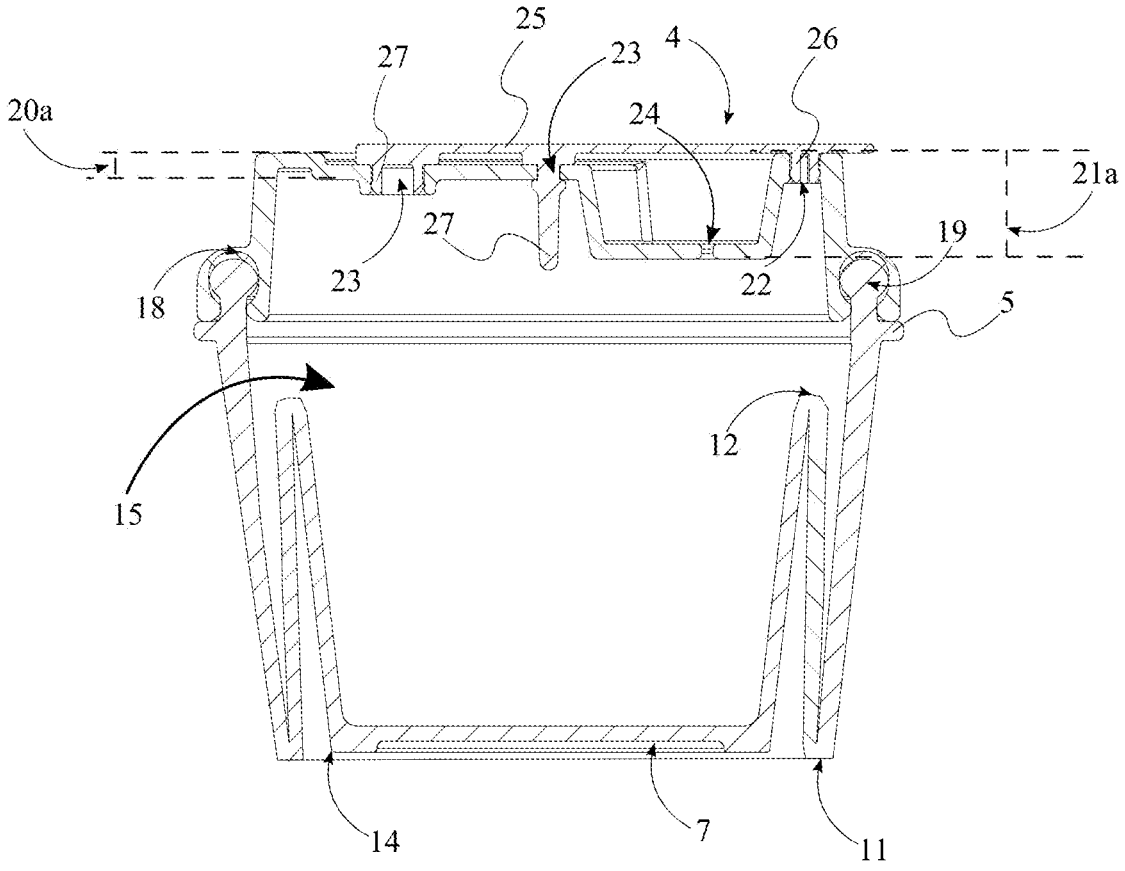
FIG. 9 is a sectional view of the present invention taken along B-B' of FIG. 8.

Conversely, in reference to FIG. 7 through FIG. 9, when the receptacle 1 is in a folded configuration, the collapsible section 9 is folded within the first section 8 along the first indentation 11, and the second section 10 is nested within the first section 8, such that the base 7 is coplanar with the first indentation 11. As seen in FIG. 8 and FIG. 9, the folded configuration reduces the volume of the receptacle 1 from the extended configuration, in such a way that, the entire collapsible section is folded in, and the entire second section 10 is pushed inwards to occupy some volume of the inner compartment 2 within the first section 8. This arrangement allows for using the collapsible beverage container for carrying smaller volumes of beverages, as well as provides a compact storage option.

As seen in FIG. 1 through FIG. 10, the lid 3 is positioned over the inner compartment 2 and the lid 3 resembles the shape of the receptacle 1. More specifically, the lid 3 acts as a cover for the collapsible beverage container, so as to keep the beverage secured, and maintain the temperature of the beverage for longer duration. According to the preferred embodiment, the lid 3 is removably connected to the first end 13, such that the collapsible beverage container may be used with or without a lid. As seen in FIG. 3, FIG. 4, FIG. 6 and FIG. 8, the lid 3 comprises a first lid body 16 and a second lid body 17, wherein the second lid body 17 is perimetrically attached to the first lid body 16, and opposite to the first end 13. Further, the first lid body 16 is positioned adjacent the first end 13 and the second lid body 17 is perimetrically attached to the first lid body 16, in a direction opposite to the first end 13. More specifically, the first lid body 16 takes the shape of the folding cup, and snuggly fits to the mouth of the receptacle 1. However, it should be noted that the lid 3 may comprise any other shape, size, color, components or arrangement of components that are known to one of ordinary skill in the art, as long as the objectives of the present invention are fulfilled.

In order to securely fasten the lid 3 to the receptacle 1, the present invention comprises a groove 18 and a rib 19. In the preferred embodiment, the groove 18 laterally traverses into and around an interior sidewall 20 of the first lid body 16. In other words, the groove 18 is a passage that runs around the first lid body 16 and acts as a female component of the secured closing mechanism between the lid 3 and the receptacle 1. Further, the rib 19 is attached perimetrically around the first section 8, and the rib 19 is positioned adjacent to the rim 5. Preferably, the rib 19 is a tubular structure that constitutes the male component of the closing mechanism between the lid 3 and the receptacle 1. Accordingly, the rib 19 engages into the groove 18 to form a spill proof lock. In other words, the rib 19 fits perfectly within the groove 18 preventing any spillage of the beverage in the collapsible container. However, the groove 18 and rib 19 can comprise any other shape size or closure mechanism that is known to one of ordinary skill in the art, as long as the intents of the present invention is not altered.

In an alternate embodiment of the present invention, the first lid body 16 may have an optional lid flap mounted perimetrically around the groove 18, wherein the lid flap acts as a protective barrier so as to prevent any leakage of the beverage from the lid. In other words, in order to provide a secure and tight fit when attaching the lid 3 to the receptacle 1, the lid flap serves as extended wings, keeping off liquids and applying pressure to the closing mechanism.

Figure 5:
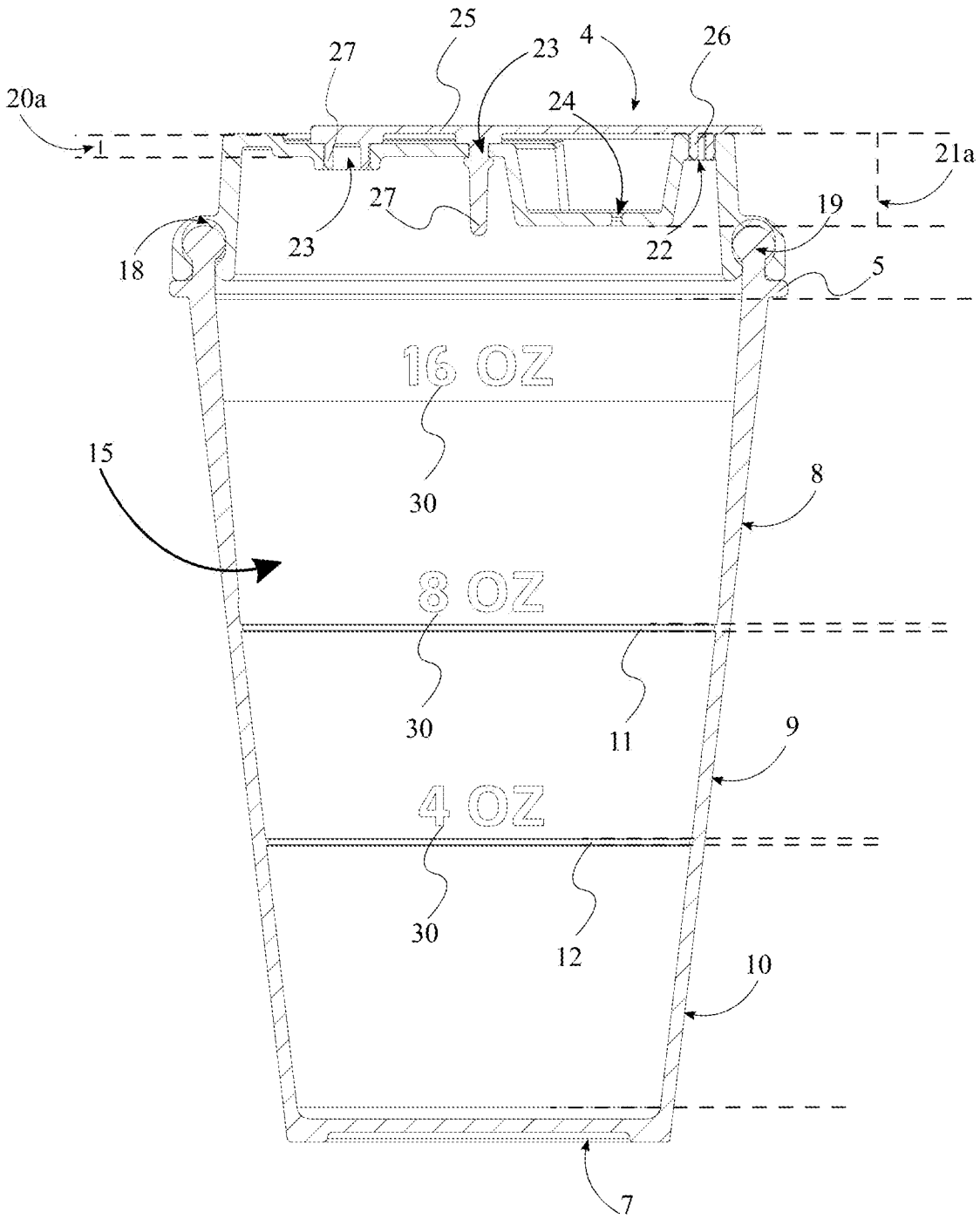
FIG. 5 is a sectional view of the present invention taken along A-A' of FIG. 4.
Figure 10:
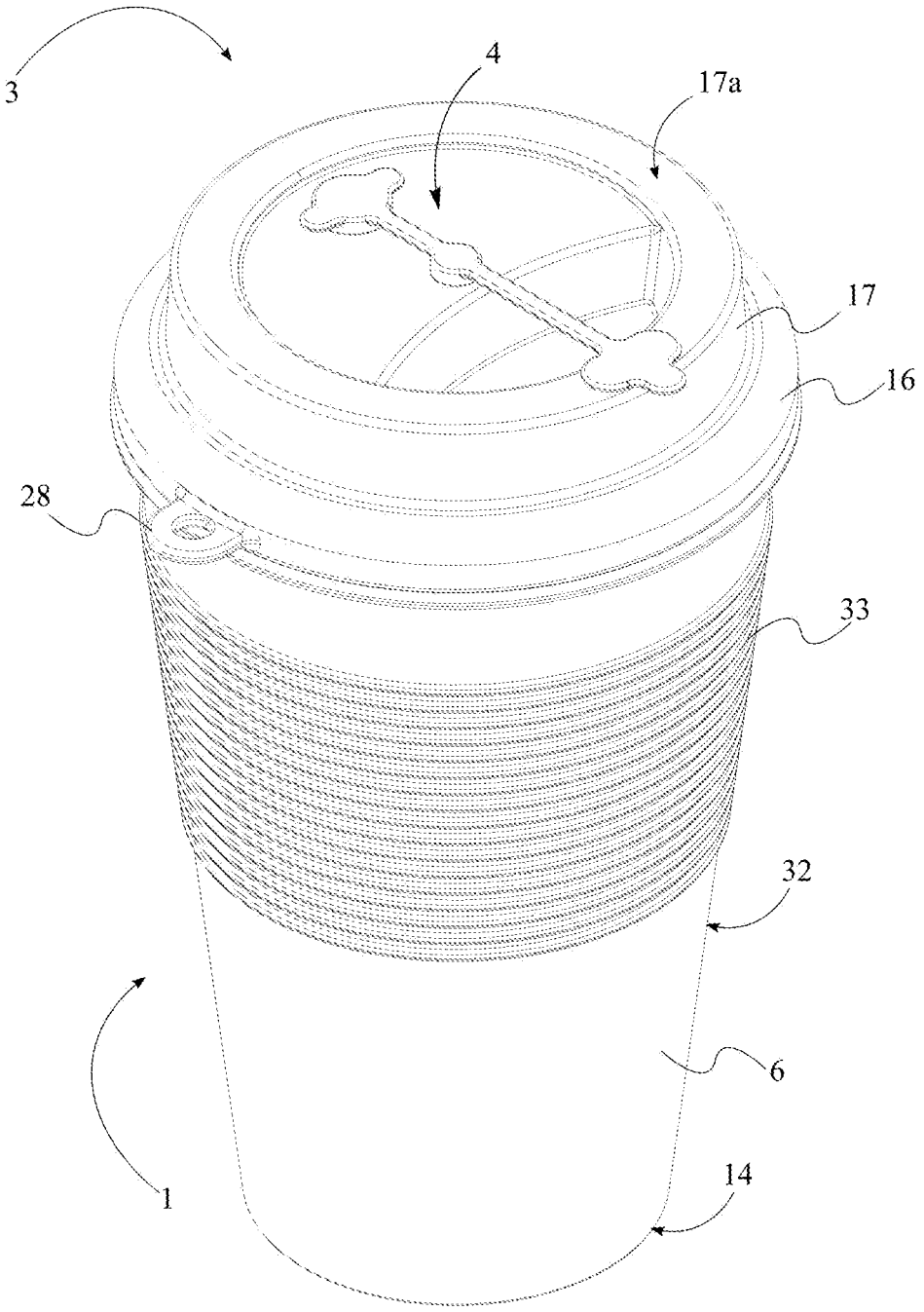
FIG. 10 is an alternate embodiment of the present invention, with an inbuilt protective sleeve.

Continuing with the preferred embodiment, the second lid body 17 comprises a first recess 20, a second recess 21, a first aperture 22, a plurality of second apertures 23, and a third aperture 24. As seen in FIG. 3, FIG. 4, FIG. 6 and FIG. 8 an upper surface 17*a* of the second lid body 17 is positioned offset from the first lid body 16, opposite to the first section 8. More specifically, the second lid body 17 is an elevated structure that acts as a mouthpiece for the user to drink from. As seen in FIG. 1, FIG. 6, and FIG. 10, the first recess 20 and the second recess 21 traverse into the second lid body 17 normal to the upper surface 17*a*. Further, as seen in FIG. 5 and FIG. 9, the first recess 20 is positioned adjacent the upper surface 17*a* and a depth 20*a* of the first recess 20 is smaller than a depth 21*a* of the second recess 21. Preferably, the first recess 20 and the second recess 21 act as platforms for the various apertures to traverse through and fulfill their functionalities. Accordingly, the first aperture 22, the plurality of second apertures 23 and the third aperture 24 traverse through the second lid body 17, wherein the plurality of second apertures 23 is positioned within the first recess 20, and the third aperture 24 is positioned within the second recess 21. As seen in FIG. 6, the first aperture 22 resides on the upper surface 17*a* and acts as a mouthpiece for the user to sip from. Preferably, the plurality of second apertures 23 serves as a platform for inserting drinking straw and the lid closure 4, and third aperture 24 is an opening that serves as a ventilation system for the beverage container. However, it should be noted that the second lid body may comprise recesses and apertures of any other shape, size, orientation and positioning, as long as the intents of the present invention are not altered.

As seen in FIG. 1, FIG. 5, FIG. 6, FIG. 9, and FIG. 10, the lid closure 4 serves as a cover for the first aperture 22 and the plurality of second apertures 23. More specifically, the lid closure 4 fits into the first aperture 22 and the plurality of second apertures 23 in order to prevent any spill. Accordingly, the lid closure 4 comprises a stem 25, a primary protrusion 26, and a plurality of protrusions 27. Preferably, the primary protrusion 26 is connected adjacent to the stem 25 and the primary protrusion 26 engages into the first aperture 22. Further, the plurality of protrusions 27 is distributed along the stem 25, wherein each of the plurality of protrusions 27 is engaged within a corresponding aperture from the plurality of second apertures 23. However, the lid closure 4 may comprise any other shape, size, orientation, components and arrangement of components, as long as the objectives of the present invention are not hindered.

According to the preferred embodiment, the present invention further comprises a tab 28. As seen in FIG. 1, FIG. 4, FIG. 6, FIG. 8, and FIG. 10, the tab 28 is mounted onto the first lid body 16 and the tab 28 extends away from the first lid body 16. Preferably, the tab 28 is an extruded structure that acts as a platform which allows the user to open the lid 3 securely. The tab 28 further comprises a tab hole 29, wherein the tab hole 29 traverses through the tab 28. Preferably, the tab hole 29 is a small circular aperture that serves as an optional utility hole or as a port hole for threading an additional fastening element such as a D-clip, a snap clip or a wrist band.

It is an aim of the present invention to provide markers with indication, which allows the user to know exactly the amount of beverage that they are pouring into the collapsible beverage container. In order to accomplish that, the present invention comprises at least one volume indicia 30, wherein the at least one volume indicia 30 is positioned along the inner surface 15 of the lateral sidewall. Further, the present invention comprises a braille impression 31 for helping visually handicapped users to identify the capacity of the container. Accordingly, the braille impression 31 depicts a total capacity of the receptacle 1, and the braille impression 31 is positioned along an outer surface 32 of the lateral sidewall 6, wherein the outer surface is positioned opposite to the inner surface across the lateral sidewall 6.

In reference to FIG. 10, the present invention comprises a protective sleeve 33, wherein the protective sleeve 33 is attached onto the outer surface 32 and encapsulating the lateral sidewall 6. Preferably, the protective sleeve 33 is a heat-resistant comfort grip that allows ergonomic comfort to the user while handling the collapsible beverage container. In the preferred embodiment of the present invention, the protective sleeve 33 is removable from the receptacle. However, in another embodiment of the present invention, the protective sleeve 33 is built onto the lateral sidewall 6.

Although the invention has been explained in relation to its preferred embodiment, it is to be understood that many other possible modifications and variations can be made without departing from the spirit and scope of the invention as hereinafter claimed.

What is claimed is:

1. A foldable container
comprising: a
receptacle having
an inner compartment;
the receptacle comprising a rim, at least one lateral sidewall, and a base defining said inner compartment, said at least one lateral sidewall having a smooth outer surface and an inner surface; the at least one lateral sidewall comprising a first section, a collapsible section and a second section, a first indentation on said inner surface of said at least one lateral sidewall, and a second indentation on said inner surface of said at least one lateral sidewall;
a first end of the receptacle being positioned opposite to a second end of the receptacle, across the lateral sidewall;
the inner compartment traversing into the receptacle from the first end to the second end;
the rim being mounted adjacent the first end;
the base being mounted adjacent the second end;
the first section being positioned adjacent to the first end;
the second section being positioned adjacent to the second end;
the collapsible section being connected in between the first section and the second section;
the lateral sidewall tapering from the first end to the second end;
the first indentation and the second indentation laterally traversing into and around an inner surface of the lateral sidewall wherein said outer surface remains seamless;
the first indentation being positioned in between the first section and the collapsible section; and
the second indentation being positioned in between the second section and
the collapsible section wherein said foldable container is made en of flexible and temperature resistant silicone
a lid;
the lid comprising a first lid body and a
second lid body; the lid being removably
connected to the first end;
the lid being positioned over the inner cavity;
the first lid body being positioned adjacent the first end; and
the second lid body being perimetrically attached to the first lid body,
a groove;
a rib;
the groove laterally traversing into and around an interior sidewall of the first lid body;
the rib being attached perimetrically around the first section; the rib being positioned adjacent to the rim; and
the rib engaging into said groove to form a spill proof lock
a first recess;
a second recess;
a first aperture;
a second aperture; a
third aperture;
an upper surface of the second lid body being positioned offset from the first lid body, opposite to the first section;
the first recess being positioned adjacent the upper surface;
a depth of the second recess being greater than a depth of the first recess such that a collection section is formed therebetween for the collection of any spilled fluid; the first recess and the second recess traversing into the second lid body
normal to the upper surface;
the first aperture traversing through the second lid body;
the second aperture traversing through the second lid body; the second aperture being positioned within the first recess; the third aperture traversing through the second lid body; and
the third aperture being positioned within the second recess a lid closure;
the lid closure comprising a stem, a primary protrusion, and a secondary protrusion;
the primary protrusion being connected adjacent to the stem;
the primary protrusion engaging into the first aperture;
the second protrusion being distributed along the stem; and
said second protrusion being engaged within said second aperture.

2. The foldable container of claim 1, comprising:
a tab;
a tab hole;
the tab being mounted onto the first lid body;
the tab extending away from the first lid body; and
the tab hole traversing through the tab.

* * * * *